US010061252B2

(12) United States Patent
Sone

(10) Patent No.: US 10,061,252 B2
(45) Date of Patent: Aug. 28, 2018

(54) IMAGE FORMING APPARATUS THAT CHANGES OVER PAPER FEEDING STAGES

(71) Applicant: KYOCERA Document Solutions Inc., Osaka (JP)

(72) Inventor: Daiki Sone, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/283,165

(22) Filed: Sep. 30, 2016

(65) Prior Publication Data

US 2017/0088377 A1 Mar. 30, 2017

(30) Foreign Application Priority Data

Sep. 30, 2015 (JP) ..... 2015-193602

(51) Int. Cl.
*B65H 7/04* (2006.01)
*G03G 15/00* (2006.01)

(52) U.S. Cl.
CPC ..... *G03G 15/6508* (2013.01); *B65H 7/04* (2013.01); *B65H 2405/332* (2013.01); *B65H 2511/515* (2013.01); *B65H 2511/528* (2013.01); *B65H 2601/255* (2013.01)

(58) Field of Classification Search
CPC ..... G03G 15/6508; B65H 7/00; B65H 7/04; B65H 2511/515; B65H 2511/528; B65H 2601/255; B65H 2405/332
See application file for complete search history.

(56) References Cited

U.S. PATENT DOCUMENTS 5,168,316 A * 12/1992 Hino ..... G03G 15/6508 271/9.03
6,785,507 B2 * 8/2004 Asai ..... G03G 15/6508 399/391
8,167,295 B2 * 5/2012 Hashimoto ..... B41J 13/0018 271/9.02
2009/0261524 A1 * 10/2009 Nakayama ..... B65H 3/44 271/3.14
2012/0286465 A1 * 11/2012 Ooba ..... B65H 3/44 271/9.01
2017/0088378 A1 * 3/2017 Sone ..... G03G 15/6508

FOREIGN PATENT DOCUMENTS

JP 2013-175880 A 9/2013

* cited by examiner

*Primary Examiner* — Ernesto A Suarez
(74) *Attorney, Agent, or Firm* — Hawaii Patent Services; Nathaniel K. Fedde; Kenton N. Fedde

(57) ABSTRACT

Provided is an image forming apparatus avoiding possibility of sheet jam occurrence, and also maintains convenience for user. The apparatus is provided with plural stages detachably loaded therein, having a common carrying passage carrying a sheet from a lower stage, a sheet detection sensor that detects a sheet stored in stage, and plural searching patterns varying in priority levels in stage searching, and includes a stage searching part that, every time feeding from stage is performed, performs stage searching based on any one of the searching patterns, and a system control part that notifies stage searching part of detection result by sensor and stage specified as default, stage searching part selecting pattern according to detection result and default to perform stage searching, and system control part performing stage change-over based on priority levels in stage searching in pattern selected.

8 Claims, 6 Drawing Sheets

FIG.3A SEARCHING PATTERN 1
| | | |
|---|---|---|
| 300 | MP TRAY | PAPER SHEET PRESENCE |
| 301 | PAPER FEEDING CASSETTE | PAPER SHEET PRESENCE |
| 302 | PAPER FEEDING CASSETTE | PAPER SHEET PRESENCE |
| 303 | PAPER FEEDING CASSETTE | PAPER SHEET PRESENCE |
| 304 | PAPER FEEDING CASSETTE | PAPER SHEET PRESENCE |
| 305 | PAPER FEEDING CASSETTE | PAPER SHEET PRESENCE |
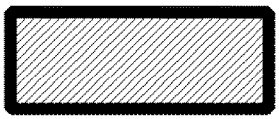
DEFAULT
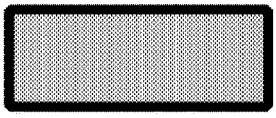
PAPER SHEET ABSENCE FIG.3B SEARCHING PATTERN 2
| | | |
|---|---|---|
| 300 | MP TRAY | PAPER SHEET PRESENCE |
| 301 | PAPER FEEDING CASSETTE | PAPER SHEET PRESENCE |
| 302 | PAPER FEEDING CASSETTE | PAPER SHEET PRESENCE |
| 303 | PAPER FEEDING CASSETTE | PAPER SHEET ABSENCE |
| 304 | PAPER FEEDING CASSETTE | PAPER SHEET PRESENCE |
| 305 | PAPER FEEDING CASSETTE | PAPER SHEET PRESENCE |
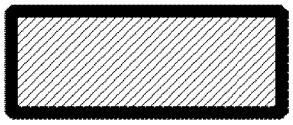
DEFAULT
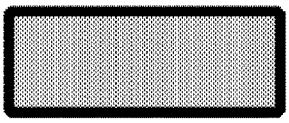
PAPER SHEET ABSENCE FIG.3C SEARCHING PATTERN 3
| | | |
|---|---|---|
| 300 | MP TRAY | PAPER SHEET PRESENCE |
| 301 | PAPER FEEDING CASSETTE | PAPER SHEET PRESENCE |
| 302 | PAPER FEEDING CASSETTE | PAPER SHEET PRESENCE |
| 303 | PAPER FEEDING CASSETTE | PAPER SHEET ABSENCE |
| 304 | PAPER FEEDING CASSETTE | PAPER SHEET PRESENCE |
| 305 | PAPER FEEDING CASSETTE | PAPER SHEET PRESENCE |
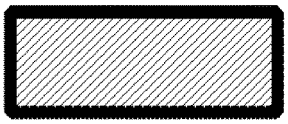
DEFAULT
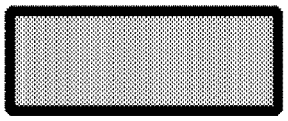
PAPER SHEET ABSENCE

IMAGE FORMING APPARATUS THAT CHANGES OVER PAPER FEEDING STAGES

INCORPORATION BY REFERENCE

This application is based on and claims the benefit of priority from Japanese Patent Application No. 2015-193602 filed on Sep. 30, 2015, the contents of which are hereby incorporated by reference.

BACKGROUND

The present disclosure relates to an image forming apparatus that reads a document to generate image data.

For example, image forming apparatuses that are an MFP (Multifunction Peripheral), such as a printer, a multi-function printer, or a multifunction machine, are often provided with a plurality of paper feeding stages in consideration of convenience of users, and the like. In this way, by providing a plurality of paper feeding stages, in the event that, during printing, all sheets in a particular paper feeding stage that is feeding paper are used up, it is made possible to feed paper from another paper feeding stage that stores sheets of, for example, the same type (such as paper quality or size). Thereby, occurrence of an interruption of printing processing can be avoided to allow continuous printing, whereby the convenience of user can be maintained.

As the typical technique for selecting a paper feeding stage in an image forming apparatus, there is available a technique that selects a paper feeding tray according to the levels of priority corresponding to the selected function. This technique specifies the levels of priority for the paper feeding trays based on the information about the levels of priority that have been specified for a plurality of functions. The functions mentioned here refer to the functions loaded on an image forming apparatus, such as copying, printing, facsimile communication, scanning, E-mail transmission, filing, and report printing. In addition, the levels of priority mentioned here refer to such an order of selection as that in which, in the case of, for example, printing in a copying job, paper sheet feeding from, for example, the paper feeding stage that stores sheets of high-quality paper is first performed in consideration of the image quality.

SUMMARY

An image forming apparatus according to an embodiment of the present disclosure is an image forming apparatus, including a plurality of paper feeding stages that are detachably loaded in the inside of a main body of the apparatus, having a common carrying passage that carries a paper sheet from a lower stage, a paper sheet detection sensor that detects a paper sheet stored in the paper feeding stage, and a processor, upon the processor executing a program, the processor operating as a paper feeding stage searching part that has a plurality of searching patterns that vary in levels of priority in paper stage searching operation, and that, every time paper sheet feeding from the paper feeding stage is performed, performs a paper feeding stage searching operation based on any one of the searching patterns, and a system control part that notifies the paper feeding stage searching part of a detection result by the paper sheet detection sensor and the paper feeding stage that is specified as the default, upon the processor executing a program, the processor selecting, as the paper feeding stage searching part, the searching pattern according to the detection result and the default to perform a feeding stage searching operation, and performing, as the system control part, changeover of the paper feeding stages based on the levels of priority in paper feeding stage searching operation in the searching pattern that has been selected.

BRIEF DESCRIPTION OF THE DRAWINGS

FIG. 3A shows a searching pattern 1 in paper feeding stage searching operation by a paper feeding stage searching part in FIG. 2;

FIG. 3B shows a searching pattern 2 in paper feeding stage searching operation by a paper feeding stage searching part in FIG. 2;

FIG. 3C shows a searching pattern 3 in paper feeding stage searching operation by a paper feeding stage searching part in FIG. 2.

DETAILED DESCRIPTION

Hereinbelow, an embodiment of an image forming apparatus of the present disclosure will be explained with reference to FIG. 1 to FIG. 4. As an example of an image forming apparatus in the following explanation, the image forming apparatus is assumed to be an MFP (Multifunction Peripheral), which is a multifunctional peripheral that provides multiple operation functions for such jobs as copying, printing, and facsimiling. In addition, it is assumed that the MFP in the present embodiment is provided with no cassette detection sensor that detects the open/closed state of the paper feeding cassette as a paper feeding stage. In addition, it is assumed that, with the MFP in the present embodiment, a plurality of paper feeding cassettes provided with a common carrying passage for a paper sheet fed from a paper feeding cassette located at a lower stage are disposed, being vertically stacked, as described later.

Figure 1:
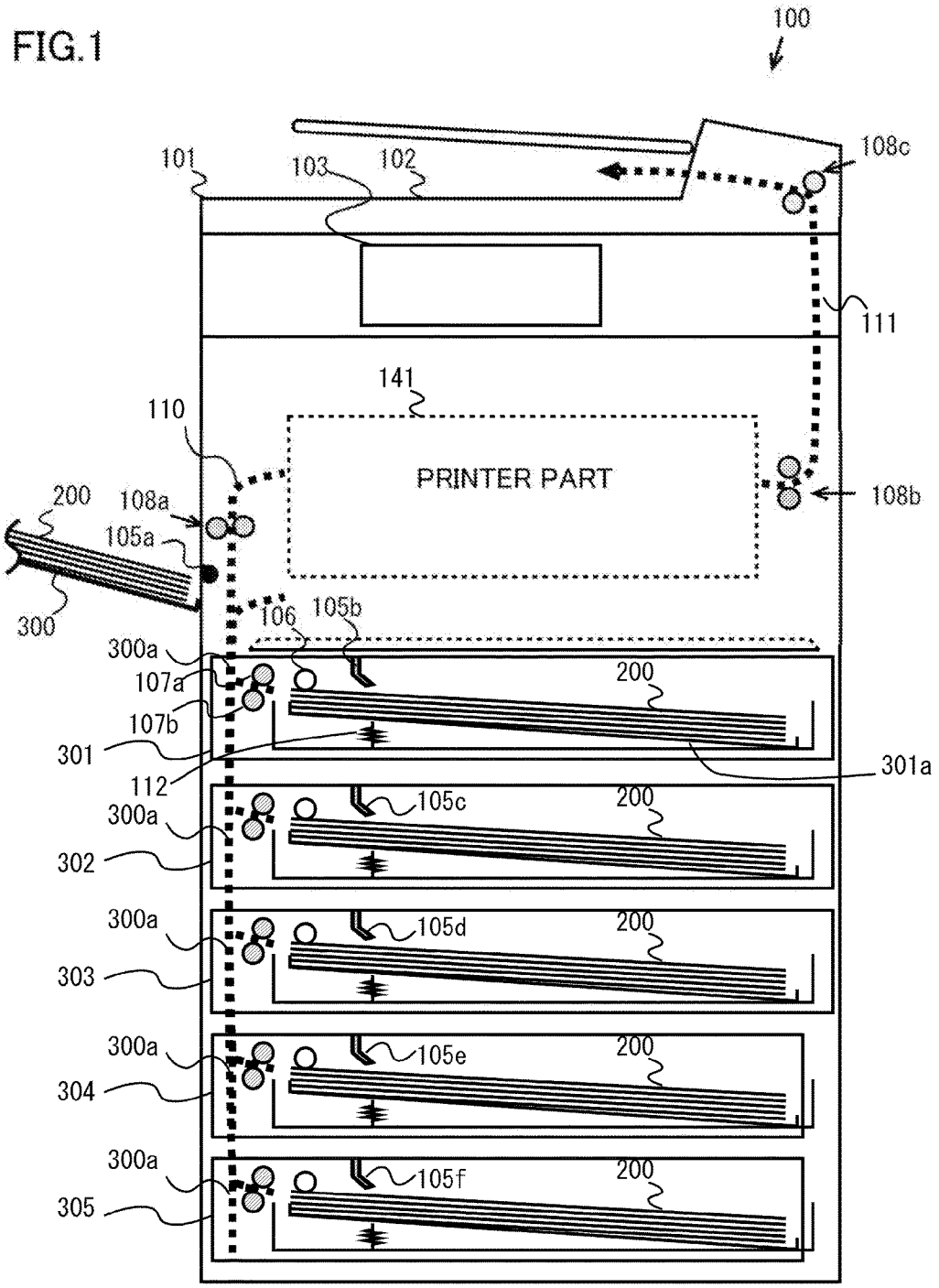
FIG. 1 shows an embodiment in the case where the image forming apparatus in the present disclosure is assumed to be an MFP.

First, as shown in FIG. 1, in an MFP 100, a paper discharging tray 102 and a panel part 103 are provided in the upper part of an MFP main body 101. In addition, on the side part of the MFP main body 101, there is provided an MP (Multipurpose) tray 300 as a manual feed tray in which a paper sheet 200 of any type (such as paper quality or size) can be set. The paper sheet 200 that has been set in the MP tray 300 is fed out into a later-described carrying passage 110.

In the inside of the MFP main body 101, there is disposed a printer part 141 having such components as a photosensitive drum. Under the printer part 141, a plurality of paper feeding cassettes 301 to 305, which store a plurality of paper sheets 200, are disposed, being vertically stacked. The number of the paper feeding cassettes 301 to 305 is not limited to 5, as shown in the figure. In other words, the number may be four or smaller, or six or larger.

In addition, these paper feeding cassettes 301 to 305 are freely attachable/detachable to/from the MFP main body 101. In addition, for the respective paper feeding cassettes 301 to 305, there is provided with a common carrying passage 300*a*, which is used for carrying a paper sheet 200 that is fed from a paper feeding cassette located at a lower stage. The common carrying passages 300*a* are linked to a later-described carrying passage 110 with the respective paper feeding cassettes 301 to 305 being stored in the MPF main body 101. If any one of the paper feeding cassettes 301 to 305 is brought into the open state for such a purpose as replenishing it with paper sheets 200, the common carrying passage 300*a* is lost. In this case, if a paper sheet is fed from any one of the paper feeding cassettes that are located under the paper feeding cassette that has been brought into the open state, there is the possibility that a paper sheet jam may be caused.

In the present embodiment, there is provided no cassette detection sensor that detects the open/closed state of the paper feeding cassette, and thus, from the result of detection by later-described paper sheet detection sensors 105*a* to 105*f*, the paper feeding cassette 301 to 305, which has no paper sheets 200, may be determined to be in the open state, depending upon the case. Then, by avoiding paper sheet feeding from any one of the paper feeding cassettes 301 to 305 that are located under the paper feeding cassette 301 to 305 that has been determined to be in the open state, the possibility that a paper sheet jam may be caused is released.

In addition, in the inside of the MFP main body 101, there are disposed paper sheet detection sensor 105*a* to 105*f*, a feeding roller 106, a driving roller 107*a*, and a driven roller 107*b*. The paper sheet detection sensors 105*b* to 105*f*, the feeding roller 106, the driving roller 107*a*, and the driven roller 107*b* are disposed in correspondence to the loading position of the respective paper feeding cassettes 301 to 305. The paper sheet detection sensor 105*a* is disposed in correspondence to the loading position of the MP tray 300. Here, the paper sheet detection sensors 105*a* to 105*f* may be mechanical or optical one.

In addition, in the inside of the MFP main body 101, there are provided conveyance rollers 108*a* to 108*c*. The conveyance rollers 108*a* are disposed on both sides of the carrying passage 110 from the respective MP tray 300 and paper feeding cassettes 301 to 305 to the printer part 141. In addition, the conveyance rollers 108*b* and 108*c* are disposed on both sides of the carrying passage 111 from the printer part 141 to the paper discharging tray 102.

In the paper feeding cassettes 301 to 305, there is provided a lifting plate 301*a*, which is pushed up at a place opposed to the feeding roller 106 by a lifting member 112, which is provided in the inside of the MFP main body 101.

Then, with the lifting plate 301*a* being pushed up by the lifting member 112, the distal end portion of the paper sheet 200 on the lifting plate 301*a* is pressed against the feeding roller 106. Thereby, the paper sheets 200 in the paper feeding cassettes 301 to 305 are fed out one by one by the feeding roller 106. In addition, in the state in which the distal end portion of the paper sheet 200 on the lifting plate 301*a* is pushed up, detection of the paper sheet 200 by the paper sheet detection sensors 105*b* to 105*f* is performed. The paper sheet detection sensor 105*a* detects the existence of a paper sheet 200 in the state in which the paper sheet 200 is set in the MP tray 300.

Here, if the paper sheet detection sensors 105*a* to 105*f* detect the paper sheet 200 that is stored in the MP tray 300 and the paper feeding cassettes 301 to 305, the paper sheet detection sensors 105*a* to 105*f* detect paper sheet presence. Contrarily, if the paper sheet detection sensors 105*a* to 105*f* cannot detect the paper sheet 200 that is stored in the MP tray 300 and the paper feeding cassettes 301 to 305, the paper sheet detection sensors 105*a* to 105*f* detect paper sheet absence. Specifically, if no paper sheet 200 is stored in the MP tray 300 and the paper feeding cassettes 301 to 305, the paper sheet detection sensors 105*a* to 105*f* detect paper sheet absence. However, if the paper feeding cassette 301 to 305 is in the open state, the paper detection sensor 105*b* to 105*f* cannot detect any paper sheet 200 that is stored in the paper feeding cassette 301 to 305. In this case, regardless of whether or not a paper sheet 200 is stored in the paper feeding cassette 301 to 305, there will be given a determination of paper sheet absence. Such determination is performed by a later-described system control part 132.

The paper sheet 200 that has been fed by the feeding roller 106 is conveyed to the printer part 141 by the conveyance rollers 108*a* along the carrying passage 110. In addition, the paper sheet 200 in the MP tray 300 is also conveyed to the printer part 141 along the carrying passage 110. The paper sheet 200, which has been subjected to printing by the printer part 141, is conveyed to the paper discharging tray 102 by the conveyance rollers 108*b* and 108*c* along the carrying passage 111.

Figure 2:
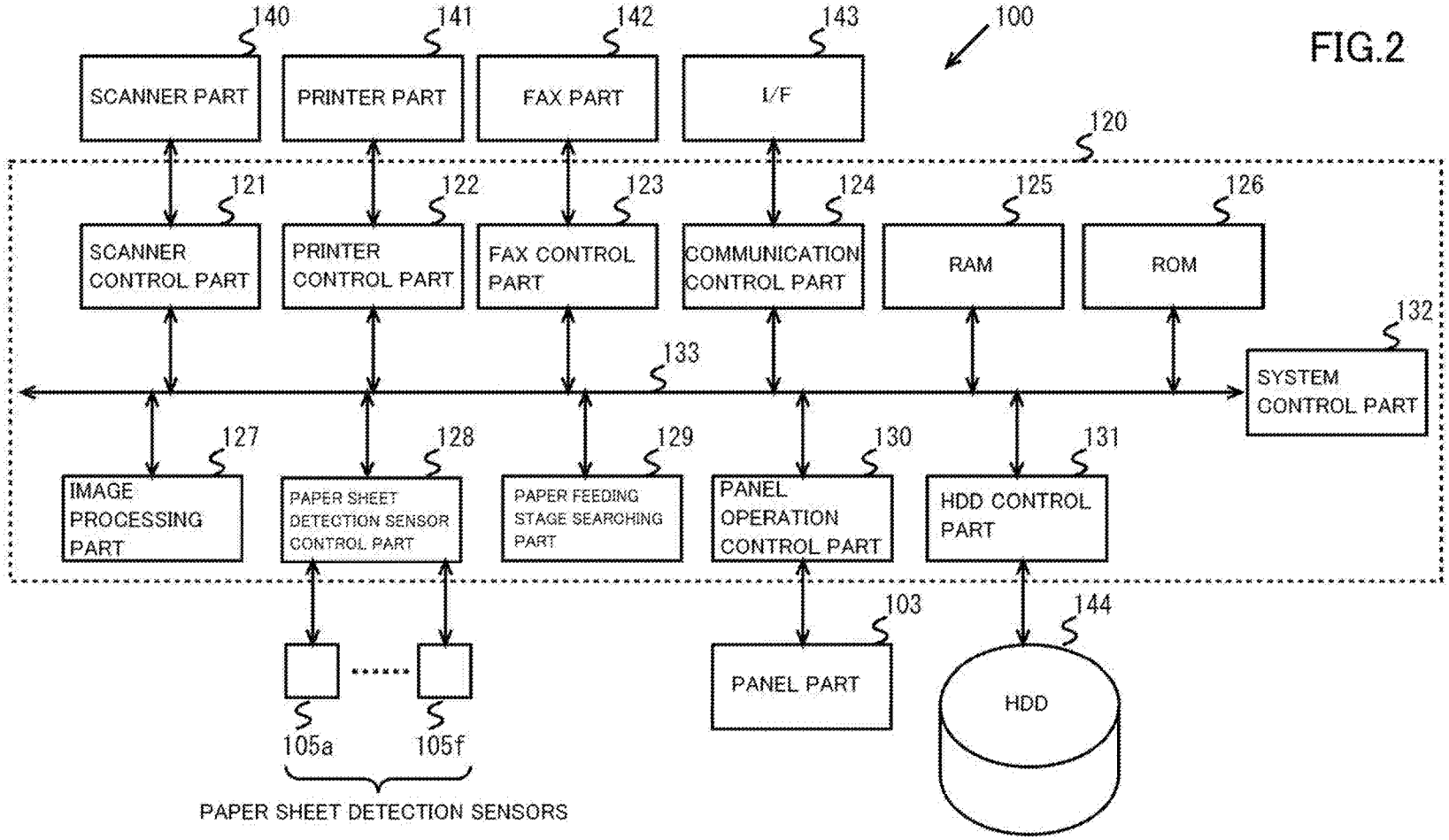
FIG. 2 illustrates a configuration of the MFP in FIG. 1.

Next, with reference to FIG. 2, the configuration of the MFP 100 will be explained. The MFP 100 includes a control part 120, a scanner part 140, a printer part 141, a FAX part 142, an I/F (interface) 143, paper sheet detection sensors 105*a* to 105*f*, a panel part 103, and an HDD (hard disk drive) 144.

The scanner part 140 inputs image data of a document read by an image sensor to the control part 120. In other words, the scanner part 140 converts an image signal for the document from the image sensor into digital image data, and sequentially inputs it to the control part 120.

The printer part 141 prints an image on the paper sheet 200 based on the image data outputted from the control part 120. The FAX part 142 transmits the image data outputted from the control part 120 to a facsimile on the opposite party through a telephone line, and receives image data from the facsimile on the opposite party to input it to the control part 120. In other words, the FAX part 142 compresses and modulates the image data outputted from the control part 120 to transmit it to the facsimile on the opposite party, while controlling the connection to the telephone line with an NCU (Network Control Unit). In addition, the FAX part 142 demodulates and expands the image data from the facsimile on the opposite party to input it to the control part 120, while connecting to the telephone line with the NCU.

The I/F 143 performs a communication with a client terminal, for example, through a network, such as an in-house LAN (Local Area Network). The paper sheet detection sensors 105*a* to 105*f*, as described above, detect the paper sheet 200 that is stored in the MP tray 300 and paper feeding cassettes 301 to 305.

The panel part 103 displays operation buttons, and the like, for selecting any one of the printing function, the FAX function, and the scanning function of the MFP 100, and the type of the paper sheet 200 (such as paper quality or the size), and further for performing various types of setting operations including specifying any one of the paper feeding cassettes 301 to 305 as the default, and the like. In the HDD 144, application programs, and the like, for providing various functions of the MFP 100 are stored. In addition, in the HDD 144, a user box, and the like, are provided. The specification of default may be registered as an initial setting for the MFP 100, or may be set when the user operates the MFP 100. Here, when the user operates the MFP 100, in the case where none of the paper feeding stages (the MP tray 300 and the paper feeding cassettes 301 to 305) is selected, a paper feeding stage registered as an initial setting can be made to be the default. On the other hand, in the case where any one of the paper feeding stages is selected, the selected paper feeding stage can be made to be the default.

The control part 120 controls the entire operation of the MFP 100, including a scanner control part 121, a printer control part 122, a FAX (facsimile) control part 123, a communication control part 124, an RAM (Random Access Memory) 125, an ROM (Read Only Memory) 126, an image processing part 127, a paper sheet detection sensor control part 128, a paper feeding stage searching part 129, a panel operation control part 130, an HDD control part 131, and a system control part 132. In addition, these are connected to a data bus 133.

The scanner control part 121 controls the reading operation of the scanner part 140. The printer control part 122 controls the printing operation of the printer part 141. The FAX control part 123 controls the image data transmission/reception operation by the FAX part 142. The communication control part 124 controls the communication through the I/F 143.

The RAM 125 is a work memory for executing a program. The ROM 126 stores control programs, and the like, to perform operation check, and the like, of the respective parts. The image processing part 127 performs image processing for a printing job, for example. In addition, the image processing part 127 performs image processing for image data of a document read by, for example, the scanner part 140.

The paper sheet detection sensor control part 128 controls the detection operation about presence or absence of the paper sheet 200 by the paper sheet detection sensors 105*a* to 105*f*. In addition, when anyone of the paper sheet detection sensors 105*a* to 105*f* detects absence of the paper sheet 200, the paper sheet detection sensor control part 128 notifies the system control part 132 thereof. Specifically, being instructed by the system control part 132, the paper sheet detection sensor control part 128 notifies the system control part 132 of the result of detection by any one of the paper sheet detection sensors 105*a* to 105*f* about presence or absence of the paper sheet 200. In addition, the paper sheet detection sensor control part 128 may notify the system control part 132 of the result of detection when the printing is started and every time paper sheet feeding is performed from any one of the paper feeding stages (the MP tray and the paper feeding cassettes 301 to 305). In addition, the paper sheet detection sensor control part 128 may notify the system control part 132 of the result of detection every definite period of time (for example, 10 msec).

As later described in detail, the paper feeding stage searching part 129 performs a paper feeding stage searching operation based on any one of later-described searching patterns 1 to 3 when paper sheet feeding is requested for the first time after the printing has been started and every time paper sheet feeding is performed from the MP tray or any one of the paper feeding cassettes 301 to 305. Here, the paper feeding stage searching operation means searching for a paper feeding stage (i.e., the MP tray or any one of the paper feeding cassettes 301 to 305) from which a next paper sheet 200 is to be fed out.

The panel operation control part 130 controls the display operation of the panel part 103. In addition, the panel operation control part 130 accepts selection, by the user through the panel part 103, of any one of the printing function, the FAX function, and the scanning function. In addition, the panel operation control part 130 accepts setting, by the user through the panel part 103, of the type of the paper sheet 200 (such as paper quality or size) that is stored in the MP tray 300 or the paper feeding cassette 301 to 305. In addition, the panel operation control part 130 accepts specification, by the user through the panel part 103, of the MP tray 300 or any one of the paper feeding cassettes 301 to 305 from which paper sheet feeding is to be performed. The panel operation control part 130 notifies the system control part 132 of the received specification as the default. In addition, the panel operation control part 130 notifies the system control part 132 also of the contents of the above-mentioned selection and setting that have been accepted through the panel part 103.

The HDD control part 131 controls the writing/reading of data into/from the HDD 144, and the like. The system control part 132 mainly controls paper sheet feeding from the MP tray 300 or any one of the paper feeding cassettes 301 to 305 that is specified as the default, changeover of the paper feeding stage to the MP tray 300 or any one of the paper feeding cassettes 301 to 305 based on the levels of priority in paper feeding stage searching operation by the paper feeding stage searching part 129, and the like. The levels of priority in paper feeding stage searching operation refer to the levels of priority in the later-described paper feeding stage searching operation to be made by the paper feeding stage searching part 129, which vary for each of the later-described searching patterns 1 to 3.

In addition, when the printing function is to be executed, for example, the system control part 132 determines, based on the detection result from the paper sheet detection sensor control part 128, whether or not, of the MP tray 300 and the paper feeding cassettes 301 to 305, there is a paper feeding stage having no paper sheets 200, and notifies the paper feeding stage searching part 129 of the result of determination. In addition, the system control part 132 notifies the paper feeding stage searching part 129 of the MP tray 300 or any one of the paper feeding cassettes 301 to 305 that has been specified as the default. Then, the paper feeding stage searching part 129 performs the paper feeding stage searching operation based on any one of the searching patterns 1 to 3 based on the contents of the notification from the system control part 132.

Next, with reference to FIG. 3A to FIG. 3C, the searching patterns in paper feeding stage searching operation by the paper feeding stage searching part 129 will be explained. In FIG. 3A to FIG. 3C, only the MP tray 300 and the paper feeding cassettes 301 to 305 are shown for convenience of explanation. In addition, for convenience of explanation, it is assumed that the paper sheets 200 stored in the MP tray 300 and the paper feeding cassettes 301 to 305 are all of the same type (such as paper quality or size).

In addition, FIG. 3A shows the searching pattern 1 for the paper feeding stage searching operation to be made by the paper feeding stage searching part 129, FIG. 3B shows the searching pattern 2, and FIG. 3C shows the searching pattern 3. In addition, for the respective MP tray 300 and paper feeding cassettes 301 to 305, the case where there is the paper sheet 200 is indicated as paper sheet presence, and the case where there is no paper sheet 200 is indicated as paper sheet absence. In addition, the bold frame that is shaded with slant lines indicates the default specified by the user. In addition, when the printing is started, the paper feeding stage searching part 129 selects any one of the searching patterns 1 to 3.

In addition, in the respective searching patterns 1 to 3, the paper feeding stage searching operation is repetitively executed every time paper sheet feeding is performed. This means that, in the event that the paper sheets 200 at a paper feeding stage have been used up in the course of paper sheet feeding, paper sheet feeding from another paper feeding stage is immediately performed. Thereby, in the event that the paper sheets 200 at a paper feeding stage have been used up, interruption of the printing processing can be avoided, and continuous printing can be performed, whereby the convenience for the user is maintained. In addition, the searching patterns 1 to 3 as described below are possessed by the paper feeding stage searching part 129. The paper feeding stage searching part 129 selects any one of the searching patterns 1 to 3 based on the contents of the above-described notification from the system control part 132.

(Searching Pattern 1)

First, FIG. 3A shows the case where, at the time of starting the printing, the MP tray 300 and the paper feeding cassettes 301 to 305 have all the paper sheet 200. In other words, the contents of the notification from the system control part 132 indicate that the MP tray 300 and the paper feeding cassettes 301 to 305 have all the paper sheet 200. In addition, the contents of the notification from the system control part 132 include that the default is the paper feeding cassette 302. The paper feeding stage searching part 129 selects the searching pattern 1 based on such contents of the notification from the system control part 132.

Here, the general practice of priority ranking for paper feeding stage searching operation provides the order of paper feeding stage searching from the paper feeding stage of the default towards the lower stages. In other words, according to the general practice of priority ranking for paper feeding stage searching operation, the paper feeding stage of the default is provided with the highest level of priority in paper feeding stage searching operation, and from the paper feeding stage just under the paper feeding stage of the default towards the lowest paper feeding stage, the levels of priority in paper feeding stage searching operation are lowered in a sequential order, then, following to this, the levels of priority being lowered in a sequential order from the paper feeding stage at the highest stage towards the paper feeding stage just above the paper feeding stage of the default. Therefore, in the present embodiment, in the case where the default is the paper feeding cassette 302, the paper feeding stage searching operation is performed in the order of the paper feeding cassette 302 (the default)⇒the paper feeding cassette 303⇒the paper feeding cassette 304⇒the paper feeding cassette 305⇒the MP tray 300⇒the paper feeding cassette 301. Although it is possible to make a paper feeding stage searching operation upwards from the paper feeding stage of the default, the order of paper feeding stage searching from the paper feeding stage of the default towards the lower stages is often used in general.

Here, as with the MFP 100 in the present embodiment, in the case where there is provided no cassette detection sensor that detects the open/closed state of the respective paper feeding cassettes 301 to 305, and the plurality of paper feeding cassettes 301 to 305 provided with a common carrying passage 300*a* for a paper sheet 200 fed from a paper feeding cassette located at a lower stage are disposed, being vertically stacked, there is the need for eliminating the possibility of occurrence of a paper sheet jam and also maintaining the convenience for the user.

However, in the state in which, at the time of starting the printing, the paper feeding cassettes 301 to 305 have all the paper sheet 200, the possibility of any one of the paper feeding cassettes 301 to 305 being opened and closed for replenishing it with paper sheets 200 during execution of the printing is low. This is because, in the case where the paper feeding cassettes 301 to 305 have all the paper sheet 200, even if the paper sheets 200 in the paper feeding stage that is in the course of paper feeding are used up, paper sheet feeding is performed from the paper feeding stage at the next higher level of priority.

In this case, the paper feeding stage searching part 129 performs the paper feeding stage searching operation in the order of from the paper feeding stage of the default towards the lower stages by the searching pattern 1, which is based on the general practice of priority ranking for paper feeding stage searching operation. In the searching pattern 1, the paper feeding stage of the default (the paper feeding cassette 302) is provided with the highest level of priority in paper feeding stage searching operation, and from the paper feeding stage just under the paper feeding stage of the default (the paper feeding cassette 303) towards the lowest paper feeding stage (the paper feeding cassette 305), the levels of priority in paper feeding stage searching operation are lowered in a sequential order. Then, following to this, the levels of priority in paper feeding stage searching operation are lowered in a sequential order from the paper feeding stage at the highest stage (from the MP tray 300) towards the paper feeding stage just above the paper feeding stage of the default (towards the paper feeding cassette 301). In other words, the paper feeding stage searching part 129 performs the paper feeding stage searching operation in the order of the paper feeding cassette 302 (the default)⇒the paper feeding cassette 303⇒the paper feeding cassette 304⇒the paper feeding cassette 305⇒the MP tray 300⇒the paper feeding cassette 301. As described above, such paper feeding stage searching operation is repetitively executed every time paper sheet feeding is performed.

(Searching Pattern 2)

Next, FIG. 3B shows the case where, at the time of starting the printing, in any one of the paper feeding stages, i.e., the MP tray 300 and the paper feeding cassettes 301 to 305, the paper sheets 200 have been used up, and the paper feeding stage in which the paper sheets 200 have been used up exists under the paper feeding stage of the default. In other words, the contents of the notification from the system control part 132 indicate that the paper feeding cassette 303 has no paper sheets 200. In addition, the contents of the notification from the system control part 132 include that the default is the paper feeding cassette 301. The paper feeding stage searching part 129 selects the searching pattern 2 based on such contents of the notification from the system control part 132.

Here, based on the general practice of priority ranking for paper feeding stage searching operation, the paper feeding stage searching operation is performed from the paper feeding stage of the default towards the lower stages, in the same manner as described above. In other words, the paper feeding stage searching operation is performed in the order of the paper feeding cassette 301 (the default)⇒the paper feeding cassette 302⇒the paper feeding cassette 304⇒the paper feeding cassette 305⇒the MP tray 300.

In this case, the paper feeding cassette 303 in the state of paper sheet absence is located under the paper feeding cassette 301 of the default, and thus the possibility that the paper feeding cassette 303 may be in the open state is high. This is because, even if, in the course of paper sheet feeding from the paper feeding cassette 301 of the default, the paper feeding cassette 303, which is located under the paper feeding cassette 301, is brought into the open state, no paper sheet jam is caused, and thus for replenishing the paper feeding cassette 303 with the paper sheet 200, the paper feeding cassette 303 may be brought into the open state.

If, in this state, the paper sheets 200 in the paper feeding cassette 301 (the default) and the paper feeding cassette 302 have been used up, and paper sheet feeding is performed from the paper feeding cassette 304, which has the next higher level of priority in paper feeding stage searching operation, a paper sheet jam may be caused, since there is the possibility that the common carrying passage 300*a* for the paper feeding cassette 303 may have been lost as described above.

Then, the paper feeding stage searching part 129 performs the paper feeding stage searching operation based on the searching pattern 2. Here, the levels of priority in paper feeding stage searching operation in the searching pattern 2 are lowered in the order of the paper feeding cassette 301 (the default)⇒the paper feeding cassette 302⇒the MP tray 300⇒the paper feeding cassette 304⇒the paper feeding cassette 305.

In other words, in the searching pattern 2, for the paper feeding stages located above the paper feeding stage in the state of paper sheet absence (the paper feeding cassette 303), the general practice of priority ranking for paper feeding stage searching operation, i.e., the order of paper feeding stage searching of the paper feeding cassette 301 (the default)⇒the paper feeding cassette 302⇒the MP tray 300 is adopted. Further, in the searching pattern 2, the levels of priority in paper feeding stage searching operation on the paper feeding stages lower than the paper feeding stage in the state of paper sheet absence (the paper feeding cassette 303) (the paper feeding cassettes 304 and 305) are made lower than those of the paper feeding stages higher than the paper feeding stage in the state of paper sheet absence (the paper feeding cassette 303) (the MP tray 300 and the paper feeding cassettes 301 and 302). Further, in the searching pattern 2, for the paper feeding stages lower than the paper feeding stage in the state of paper sheet absence (the paper feeding cassette 303) (the paper feeding cassettes 304 and 305), the levels of priority in paper feeding stage searching operation are lowered in a sequential order from the higher stage to the lower stage (from the paper feeding cassette 304 to the paper feeding cassette 305). In this way, in the searching pattern 2, the paper feeding stage searching operation on the paper feeding cassette 304 and the paper feeding cassette 305, which are located under the paper feeding cassette 303 in the state of paper sheet absence, is postponed. Thereby, it is made possible to perform paper sheet feeding in the course of printing from the paper feeding cassettes 301 and 302, and the MP tray 300, which are in the state of paper sheet presence. In addition, the possibility of occurrence of a paper sheet jam is eliminated, and the convenience for the user can also be maintained. As described above, such paper feeding stage searching operation is executed every time paper sheet feeding is performed.

(Searching Pattern 3)

Next, FIG. 3C shows the case where, at the time of starting the printing, in any one of the paper feeding stages, i.e., the MP tray 300 and the paper feeding cassettes 301 to 305, the paper sheets 200 have been used up, and the paper feeding stage in which the paper sheets 200 have been used up exists above the paper feeding stage of the default. In other words, the contents of the notification from the system control part 132 indicate that the paper feeding cassette 303 has no paper sheets 200. In addition, the contents of the notification from the system control part 132 include that the default is the paper feeding cassette 304. The paper feeding stage searching part 129 selects the searching pattern 3 based on such contents of the notification from the system control part 132.

Here, as described above, the general practice of priority ranking for paper feeding stage searching operation provides the order of paper feeding stage searching from the paper feeding stage of the default towards the lower stages. In other words, in the case where the default is the paper feeding cassette 304, the paper feeding stage searching operation is performed in the order of the paper feeding cassette 304 (the default)⇒the paper feeding cassette 305⇒the MP tray 300⇒the paper feeding cassette 301⇒the paper feeding cassette 302.

In this case, the paper feeding cassette 303 in the state of paper sheet absence is located above the paper feeding cassette 304 (the default). Therefore, if paper sheet feeding is performed from either one of the paper feeding cassettes 304 and 305, which are located under the paper feeding cassette 303 in the state of paper sheet absence, a paper sheet jam may be caused since there is the possibility that the common carrying passage 300*a* for the paper feeding cassette 303 may have been lost as described above.

Then, the paper feeding stage searching part 129 performs a paper feeding stage searching operation based on the searching pattern 3. Here, the levels of priority in paper feeding stage searching operation in the searching pattern 3 are lowered in the order of the MP tray 300⇒the paper feeding cassette 301⇒the paper feeding cassette 302⇒the paper feeding cassette 304 (the default)⇒the paper feeding cassette 305. In other words, in the searching pattern 3, the highest paper feeding stage (the MP tray 300) is provided with the highest level of priority in paper feeding stage searching operation, and from the highest paper feeding stage (the MP tray 300) towards the paper feeding stage just above the paper feeding stage in the state of paper sheet absence (the paper feeding cassette 303) (the paper feeding cassette 302), the levels of priority in paper feeding stage searching operation are lowered in a sequential order. Further, in the searching pattern 3, the levels of priority in paper feeding stage searching operation on the paper feeding stages lower than the paper feeding stage in the state of paper sheet absence (the paper feeding cassette 303) (the paper feeding cassettes 304 and 305) are made lower than those of the paper feeding stages higher than the paper feeding stage in the state of paper sheet absence (the paper feeding cassette 303) (the MP tray 300 and the paper feeding cassettes 301 and 302). Further, in the searching pattern 3, for the paper feeding stages lower than the paper feeding stage in the state of paper sheet absence (the paper feeding cassette 303) (the paper feeding cassettes 304 and 305), the levels of priority in paper feeding stage searching operation are lowered in a sequential order from the higher stage to the lower stage (from the paper feeding cassette 304 to the paper feeding cassette 305). In this way, in the searching pattern 3, the paper feeding stage searching operation on the paper feeding cassette 304 and the paper feeding cassette 305, which are located under the paper feeding cassette 303 in the state of paper sheet absence, is postponed.

Thereby, it is made possible to perform paper sheet feeding in the course of printing from the MP tray 300 and the paper feeding cassettes 301 and 302, which are in the state of paper sheet presence. In this case, by making the levels of priority in paper feeding stage searching operation on the paper feeding cassettes 304 and 305, which are located under the paper feeding cassette 303 in the state of paper sheet absence, lower, the possibility of occurrence of a paper sheet jam is eliminated, and the convenience for the user can also be maintained.

In the searching patterns 2 and 3, the levels of priority in paper feeding stage searching operation on the paper feeding cassettes, which are located under the paper feeding cassette in the state of paper sheet absence, are made lower, however, it is also possible that paper feeding stage searching operation is not performed on the paper feeding stages which are located under the paper feeding stage that has no paper sheets 200.

In other words, it is assumed that, at the start of the printing, as shown in FIG. 3C, for example, there exists the paper feeding cassette 303 in the state of paper sheet absence above the paper feeding cassette 304 (the default). In this case, the paper feeding stage searching operation is performed in the order of the MP tray 300⇒the paper feeding cassette 301⇒the paper feeding cassette 302, however, the paper feeding stage searching operation is not performed in the order of the paper feeding cassette 304⇒the paper feeding cassette 305.

In this way, in the case where there exists the paper feeding cassette 303 in the state of paper sheet absence above the paper feeding cassette 304 (the default), by not performing the paper feeding stage searching operation on the paper feeding cassette 304 and the paper feeding cassette 305, which are located under the paper feeding stage that has no paper sheets 200, occurrence of a paper sheet jam can be positively avoided. The pattern of the paper feeding stage searching operation in this case is referred to as the searching pattern 4.

As described above, the paper feeding stage searching part 129 selects only the paper feeding stage in the state of paper sheet presence as the object of the paper feeding stage searching operation, and based on the levels of priority in paper feeding stage searching operation, performs change-over of paper feeding stages.

In addition, as a result of a paper feeding stage searching operation, it has been found that there are a plurality of paper feeding stages in the state of paper sheet absence, a searching pattern may be selected on the assumption that only the paper feeding stage that is the closest to the printer part 141 is the paper feeding stage in the state of paper sheet absence. Here, in the present embodiment, in the case where there are, for example, two paper feeding stages in the state of paper sheet absence, "the paper feeding stage that is the closest to the printer part 141" refers to "the paper feeding stage of them that is located above the other". Specifically, in FIG. 3A, in the case where the paper feeding cassette 301 and the paper feeding cassette 303 are in the state of paper sheet absence, the paper feeding stage searching part 129 selects the searching pattern 3 on the assumption that only the paper feeding cassette 301, which is located above the paper feeding cassette 303, is the paper feeding stage in the state of paper sheet absence. In FIG. 3B, in the case where, besides the paper feeding cassette 303, the paper feeding cassette 304 is in the state of paper sheet absence, the paper feeding stage searching part 129 selects the searching pattern 2 on the assumption that only the paper feeding cassette 303, which is located above the paper feeding cassette 304, is the paper feeding stage in the state of paper sheet absence. In FIG. 3C, in the case where, besides the paper feeding cassette 303, the paper feeding cassette 301 is in the state of paper sheet absence, the paper feeding stage searching part 129 selects the searching pattern 3 on the assumption that only the paper feeding cassette 301, which is located above the paper feeding cassette 303, is the paper feeding stage in the state of paper sheet absence. In any case, the paper feeding stage searching part 129 selects only the paper feeding stage in the state of paper sheet presence as the object of the paper feeding stage searching operation.

In the above-described embodiment, for selection of a searching pattern, it is assumed that the paper feeding stage searching operation is performed on the paper feeding stages including the MP tray 300, however, any one of the searching patterns 1 to 3 may be selected on the assumption that the paper feeding stage searching operation is performed only on the paper feeding cassettes 301 to 305, excluding the MP tray 300. In other words, even in the case where the MP tray 300 is in the state of paper sheet presence, it is excluded from the objects of the paper feeding stage searching operation.

In addition, for selection of a searching pattern, in the case where the MP tray 300 is in the state of paper sheet absence, the paper feeding stage searching part 129 may select any one of the searching patterns 1 to 3 on the assumption that only the paper feeding cassettes 301 to 305, excluding the MP tray 300, are the objects of the paper feeding stage searching operation. This is based on the fact that, as shown in FIG. 1, the MP tray 300 is not provided with a common carrying passage, and thus there is no possibility that a paper sheet jam may be caused even after the MP tray 300 having been replenished with paper sheets.

In addition, as a result of a paper feeding stage searching operation, it has been found that the paper feeding stage of the default is in the state of paper sheet absence, the paper feeding stage searching part 129 may select the searching pattern 3. In this case, the paper feeding stage searching part 129 will not provide the paper feeding stage of the default with any level of priority in paper feeding stage searching operation, and only the paper feeding stage in the state of paper sheet presence will be made the object in paper feeding stage searching operation.

In addition, in the case where the paper feeding stage in the state of paper sheet absence has been released from the state of paper sheet absence, the paper feeding stage searching part 129 may newly select any one of the searching patterns for performing the paper feeding stage searching operation.

Figure 4:
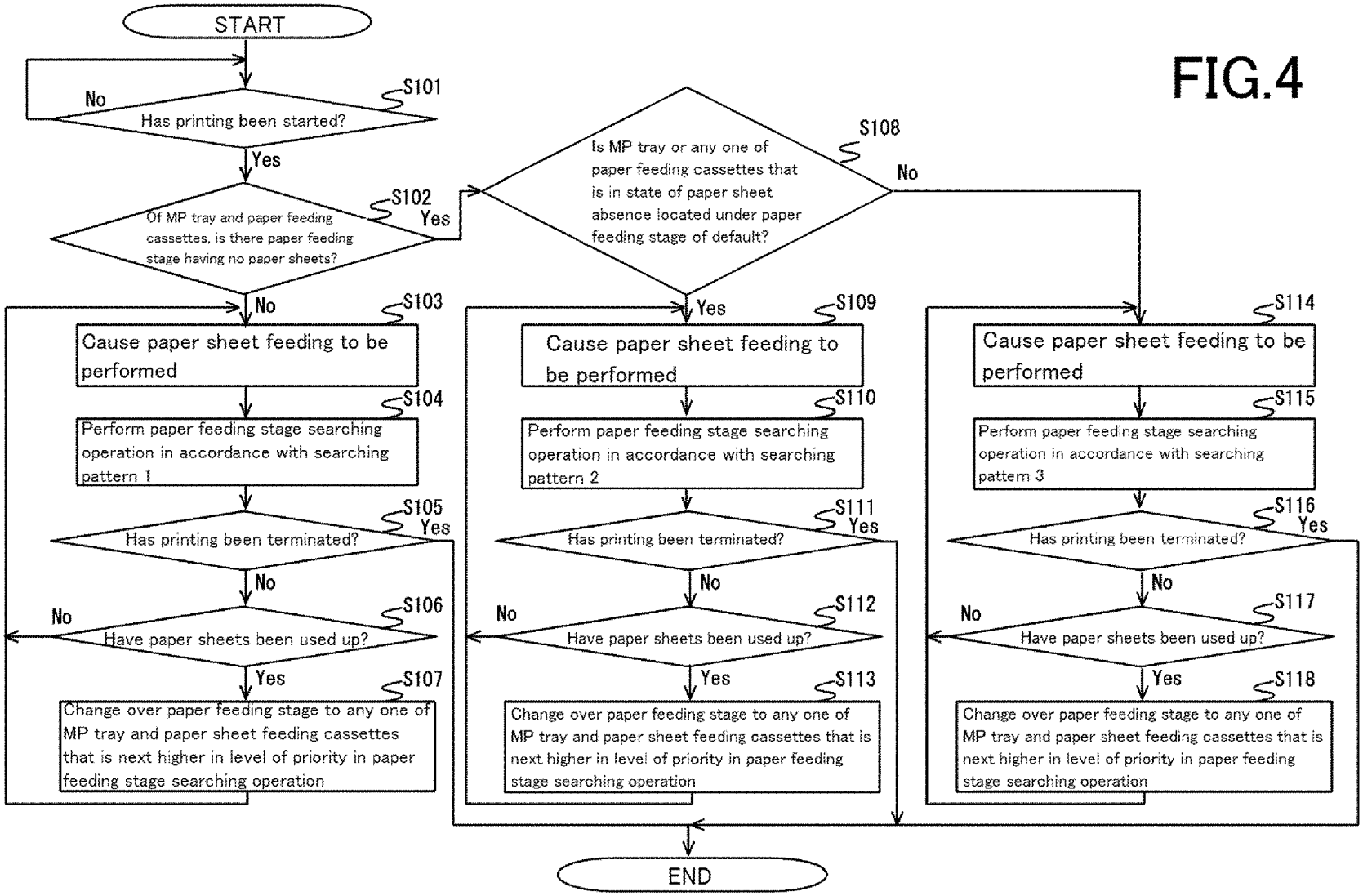
FIG. 4 illustrates the steps of operation of changing over of paper feeding stages by the MFP in FIG. 1.

Next, with reference to FIG. 4, the operation of change-over of paper sheet feeding stages by the MFP 100 will be explained. In the following explanation, it is assumed for convenience of explanation that, in the respective MP tray 300 and paper feeding cassettes 301 to 305, paper sheets 200 of the same type (such as paper quality or size) are stored. In addition, in the following explanation, it is assumed for convenience of explanation that the case where the printing function of the MFP 100 is selected.

(Step S101)

The system control part 132 determines whether or not the printing has been started. In this case, the system control part 132 waits until there is given a notification from the panel operation control part 130 of that selection of the printing function by the user has been received through the panel part 103 (NO at Step 101). Then, if there has been given a notification from the panel operation control part 130 of that selection of the printing function by the user has been received through the panel part 103, the system control part 132 determines that the printing has been started (YES at Step S101).

(Step S102)

The system control part 132 instructs the paper sheet detection sensor control part 128 to cause the paper sheet detection sensors 105*a* to 105*f* to detect whether or not there exists the paper sheet 200. Then, the system control part 132 waits for a detection result from the paper sheet detection sensor control part 128, and upon the reception of a detection result from the paper sheet detection sensor control part 128, determines whether or not, of the MP tray 300 and the paper feeding cassettes 301 to 305, there is a paper feeding stage having no paper sheets 200.

If it is determined that, of the MP tray 300 and the paper feeding cassettes 301 to 305, there is no paper feeding stage in the state of paper sheet absence (NO at Step S102), the system control part 132 proceeds to Step S103. Contrarily, if it is determined that, of the MP tray 300 and the paper feeding cassettes 301 to 305, there is a paper feeding stage in the state of paper sheet absence (YES at Step S102), the system control part 132 proceeds to Step S108.

(Step S103)

The system control part 132 causes paper sheet feeding to be performed from the MP tray 300 or anyone of the paper feeding cassettes 301 to 305 that is specified to be the default. In the case where the system control part 132 has received a specification of the MP tray 300 or any one of the paper feeding cassettes 301 to 305 as the default by the user through the panel part 103, the system control part 132 determines the default based on the specification. However, if there is no specification of the MP tray 300 or any one of the paper feeding cassettes 301 to 305 as the default through the panel part 103, the system control part 132 will determine the default based on the specification received at the previous time.

In addition, the system control part 132 instructs the printer control part 122 to perform printing by the printer part 141. In this case, the system control part 132 causes the image processing part 127 to perform image processing for a printing job, for example. In addition, the system control part 132 causes the image processing part 127 to output the processed image data to the printer control part 122.

(Step S104)

The system control part 132 instructs the paper feeding stage searching part 129 to perform a paper feeding stage searching operation. In this case, the system control part 132 notifies the paper feeding stage searching part 129 of a detection result from the paper sheet detection sensor control part 128, and the contents that have been received from the panel operation control part 130, indicating the MP tray 300 or any one of the paper feeding cassettes 301 to 305 that has been specified as the default.

It is assumed that the contents of the notification from the system control part 132, mentioned here, indicate that, at the time of starting the printing, the MP tray 300 and the paper feeding cassettes 301 to 305 have all the paper sheet 200, as explained with reference to FIG. 3A. In addition, it is assumed that the contents of the notification from the system control part 132 include that the default is the paper feeding cassette 302.

Then, the paper feeding stage searching part 129 selects the searching pattern 1 based on the contents of the notification from the system control part 132. In addition, the paper feeding stage searching part 129 performs the paper feeding stage searching operation based on the searching pattern 1 that has been explained with reference to FIG. 3A, for example.

In this case, the levels of priority in paper feeding stage searching operation in the searching pattern 1 are lowered in the order of the paper feeding cassette 302 (the default)⇒the paper feeding cassette 303⇒the paper feeding cassette 304⇒the paper feeding cassette 305⇒the MP tray 300⇒the paper feeding cassette 301, as described above. As described above, such paper feeding stage searching operation is executed every time paper sheet feeding is performed.

(Step S105)

The system control part 132 determines whether or not the printing has been terminated. In this case, upon the printing by the printer part 141 based on the image data from the image processing part 127 being terminated, the termination of the printing is notified to the system control part 132 from the printer control part 122.

Then, if the system control part 132 determines that the printing has not been terminated (NO at Step S105), it proceeds to Step S106. Contrarily, if the system control part 132 determines that the printing has been terminated (YES at Step S105), it terminates the processing.

(Step S106)

The system control part 132 determines whether or not the paper sheets have been used up. In this case, based on the detection result from the paper sheet detection sensor control part 128, the system control part 132 determines whether the paper sheets 200 in the paper feeding cassette 302 (the default), which is in the course of paper sheet feeding, have been used up.

Then, if it is determined that the paper sheets 200 in the paper feeding cassette 302 (the default) have been used up (YES at Step 106), the system control part 132 proceeds to Step S107. Contrarily, if it is determined that the paper sheets 200 in the paper feeding cassette 302 (the default) have not been used up (NO at Step 106), the system control part 132 proceeds to Step S103.

(Step S107)

If it is determined that the paper sheets 200 in the paper feeding cassette 302 (the default) have been used up, the system control part 132 changes over the paper feeding stage to the MP tray 300 or any one of the paper feeding cassettes 301 to 305 based on the levels of priority in paper feeding stage searching operation by the paper feeding stage searching part 129.

It is assumed that, at this time, the levels of priority in paper feeding stage searching operation in the searching pattern 1 that is to be made by the paper feeding stage searching part 129 are lowered in the order of the paper feeding cassette 302 (the default)⇒the paper feeding cassette 303⇒the paper feeding cassette 304⇒the paper feeding cassette 305⇒the MP tray 300⇒the paper feeding cassette 301, as described above.

In this case, the system control part 132 changes over the paper feeding stage to the paper feeding cassette 303, the level of priority in paper feeding stage searching operation on which is next higher to the level of priority in paper feeding stage searching operation on the paper feeding cassette 302 (the default).

Hereafter, until the printing at Step S105 is terminated, whenever it is determined that the paper sheets 200 have been used up, the system control part 132 controls changeover of paper feeding stages based on the levels of priority in paper feeding stage searching operation in the searching pattern 1.

(Step S108)

From the detection result from the paper sheet detection sensor control part 128, the system control part 132 determines whether or not the MP tray 300 or any one of the paper feeding cassettes 301 to 305 that is in the state of paper sheet absence is located under the paper feeding stage of the default.

If it is determined that the MP tray 300 or any one of the paper feeding cassettes 301 to 305 that is in the state of paper sheet absence is located under the paper feeding stage of the default (YES at Step S108), the system control part 132 proceeds to Step S109.

Contrarily, if it is determined that the MP tray 300 or any one of the paper feeding cassettes 301 to 305 that is in the state of paper sheet absence is not located under the paper feeding stage of the default (NO at Step S108), the system control part 132 proceeds to Step S114.

(Step S109)

From the detection result from the paper sheet detection sensor control part 128, if it is determined that the MP tray 300 or any one of the paper feeding cassettes 301 to 305 that is in the state of paper sheet absence is located under the paper feeding stage of the default, the system control part 132 causes paper sheet feeding to be performed from the MP tray 300 or any one of the paper feeding cassettes 301 to 305 that is specified to be the default. In this case, if the default is the paper feeding cassette 301, as shown in FIG. 3B, the system control part 132 causes paper sheet feeding to be performed from the paper feeding cassette 301.

In addition, in the same manner as described above, the system control part 132 instructs the printer control part 122 to perform printing by the printer part 141. In this case, in the same manner as described above, the system control part 132 causes the image processing part 127 to perform image processing for a printing job, for example. In addition, in the same manner as described above, the system control part 132 causes the image processing part 127 to output the processed image data to the printer control part 122.

(Step S110)

The system control part 132 instructs the paper feeding stage searching part 129 to perform a paper feeding stage searching operation. In this case, the system control part 132 notifies the paper feeding stage searching part 129 of a detection result from the paper sheet detection sensor control part 128, and the contents that have been received from the panel operation control part 130, indicating the MP tray 300 or any one of the paper feeding cassettes 301 to 305 that has been specified as the default.

It is assumed that the contents of the notification from the system control part 132, mentioned here, indicate that, the paper feeding cassette 303 has no paper sheets 200, as explained with reference to FIG. 3B. In addition, it is assumed that the contents of the notification from the system control part 132 include that the default is the paper feeding cassette 301.

Then, the paper feeding stage searching part 129 selects the searching pattern 2 based on the contents of the notification from the system control part 132. In addition, the paper feeding stage searching part 129 performs the paper feeding stage searching operation based on the searching pattern 2 that has been explained with reference to FIG. 3B, for example.

In this case, as described above, the levels of priority in paper feeding stage searching operation in the searching pattern 2 are lowered in the order of the paper feeding cassette 301 (the default)⇒the paper feeding cassette 302⇒the MP tray 300⇒the paper feeding cassette 304⇒the paper feeding cassette 305. As described above, such paper feeding stage searching operation is executed every time paper sheet feeding is performed.

In this way, by making the levels of priority in paper feeding stage searching operation on the paper feeding cassettes 304 and 305, which are located under the paper feeding cassette 303 in the state of paper sheet absence, lower, it is made possible to perform paper sheet feeding in the course of printing from the paper feeding cassettes 301 and 302, and the MP tray 300, which are in the state of paper sheet presence.

(Step S111)

The system control part 132 determines whether or not the printing has been terminated. In this case, upon the printing by the printer part 141 based on the image data from the image processing part 127 being terminated, the printer control part 122 notifies the system control part 132 of the termination of the printing.

Then, if the system control part 132 determines that the printing has not been terminated (NO at Step S111), it proceeds to Step S112. Contrarily, if the system control part 132 determines that the printing has been terminated (YES at Step S111), it terminates the processing.

(Step S112)

The system control part 132 determines whether or not the paper sheets 200 in the paper feeding cassette 301 (the default) in the course of paper sheet feeding have been used up. In this case, based on the detection result from the paper sheet detection sensor control part 128, if it determined that the paper sheets 200 in the paper feeding cassette 301 (the default) in the course of paper sheet feeding have been used up (YES at Step 112), the system control part 132 proceeds to Step 113. Contrarily, if it is determined that the paper sheets 200 in the paper feeding cassette 301 (the default) have not been used up (NO at Step 112), the system control part 132 proceeds to Step S109.

(Step S113)

If it is determined that the paper sheets 200 in the paper feeding cassette 301 (the default) have been used up, the system control part 132 changes over the paper feeding stage to the MP tray 300 or any one of the paper feeding cassettes 301 to 305 based on the levels of priority in paper feeding stage searching operation by the paper feeding stage searching part 129.

It is assumed that, in this case, the levels of priority in paper feeding stage searching operation in the searching pattern 2 that is to be made by the paper feeding stage searching part 129 are lowered in the order of the paper feeding cassette 301 (the default)⇒the paper feeding cassette 302⇒the MP tray 300⇒the paper feeding cassette 304⇒the paper feeding cassette 305, as described above. In this case, the system control part 132 changes over the paper feeding stage to the paper feeding cassette 302, the level of priority in paper feeding stage searching operation on which is next higher to the level of priority in paper feeding stage searching operation on the paper feeding cassette 301 (the default).

Hereafter, until the printing at Step S111 is terminated, whenever it is determined that the paper sheets 200 have been used up, the system control part 132 controls changeover of paper feeding stages based on the levels of priority in paper feeding stage searching operation in the searching pattern 2.

(Step S114)

From the detection result from the paper sheet detection sensor control part 128, if it is determined that the MP tray 300 or any one of the paper feeding cassettes 301 to 305 that is in the state of paper sheet absence is not located under the paper feeding stage of the default, the system control part 132 causes paper sheet feeding to be performed from the MP tray 300, which is located at the highest stage. In addition, in the same manner as described above, the system control part 132 instructs the printer control part 122 to perform printing by the printer part 141. In this case, in the same manner as described above, the system control part 132 causes the image processing part 127 to perform image processing for a printing job, for example. In addition, in the same manner as described above, the system control part 132 causes the image processing part 127 to output the processed image data to the printer control part 122.

(Step S115)

The system control part 132 instructs the paper feeding stage searching part 129 to perform a paper feeding stage searching operation. In this case, the system control part 132 notifies the paper feeding stage searching part 129 of a detection result from the paper sheet detection sensor control part 128, and the contents that have been received from the panel operation control part 130, indicating the MP tray 300 or any one of the paper feeding cassettes 301 to 305 that has been specified as the default.

It is assumed that the contents of the notification from the system control part 132, mentioned here, indicate that, at the time of starting the printing, the paper feeding cassette 303 has no paper sheets 200, as explained with reference to FIG. 3C. In addition, it is assumed that the contents of the notification from the system control part 132 include that the printing is to be started at the MP tray 300 rather than the paper feeding cassette 304, which is the default.

Then, the paper feeding stage searching part 129 selects the searching pattern 3 based on the contents of the notification from the system control part 132. In addition, the paper feeding stage searching part 129 performs the paper feeding stage searching operation based on the searching pattern 3 that has been explained with reference to FIG. 3C, for example.

In this case, as described above, the levels of priority in paper feeding stage searching operation in the searching pattern 3 are lowered in the order of the MP tray 300⇒the paper feeding cassette 301⇒the paper feeding cassette 302⇒the paper feeding cassette 304 (the default)⇒the paper feeding cassette 305. As described above, such paper feeding stage searching operation is executed every time paper sheet feeding is performed.

In this way, by making the levels of priority in paper feeding stage searching operation on the paper feeding cassettes 304 and 305, which are located under the paper feeding cassette 303 in the state of paper sheet absence, lower, it is made possible to perform paper sheet feeding in the course of printing from the MP tray 300⇒the paper feeding cassette 301⇒and the paper feeding cassette 302, in this order, which are in the state of paper sheet presence.

(Step S116)

The system control part 132 determines whether or not the printing has been terminated. In this case, upon the printing by the printer part 141 based on the image data from the image processing part 127 being terminated, the termination of the printing is notified to the system control part 132 from the printer control part 122.

Then, if the system control part 132 determines that the printing has not been terminated (NO at Step S116), it proceeds to Step S117. Contrarily, if the system control part 132 determines that the printing has been terminated (YES at Step S116), it terminates the processing.

(Step S117)

The system control part 132 determines whether or not the paper sheets 200 in the MP tray 300 in the course of paper sheet feeding have been used up. In this case, based on the detection result from the paper sheet detection sensor control part 128, if it determined that the paper sheets 200 in the MP tray 300 in the course of paper sheet feeding have been used up (YES at Step 117), the system control part 132 proceeds to Step 118. Contrarily, if it is determined that the paper sheets 200 in the MP tray 300 have not been used up (NO at Step 117), the system control part 132 proceeds to Step S118.

(Step S118)

If it is determined that the paper sheets 200 in the MP tray 300 have been used up, the system control part 132 changes over the paper feeding stage to any one of the paper feeding cassettes 301 to 305 based on the levels of priority in paper feeding stage searching operation by the paper feeding stage searching part 129.

It is assumed that, in this case, the levels of priority in paper feeding stage searching operation in the searching pattern 3 that is to be made by the paper feeding stage searching part 129 are lowered in the order of the MP tray 300⇒the paper feeding cassette 301⇒the paper feeding cassette 302⇒the paper feeding cassette 304 (the default) ⇒the paper feeding cassette 305, as described above. In this case, the system control part 132 changes over the paper feeding stage to the paper feeding cassette 301, the level of priority in paper feeding stage searching operation on which is next higher to the level of priority in paper feeding stage searching operation on the MP tray 300.

Hereafter, until the printing at Step S116 is terminated, whenever it is determined that the paper sheets 200 have been used up, the system control part 132 controls changeover of paper feeding stages based on the levels of priority in paper feeding stage searching operation in the searching pattern 3.

The paper feeding stage searching operations to be made by the paper feeding stage searching part 129 at Steps S104, S110, and S115 may be performed before paper sheet feeding to be made by the system control part 132 at Steps S103, S109, and S114.

In addition, in the above explanation, it is assumed that the respective MP tray 300 and paper feeding cassettes 301 to 305 store the same type (such as paper quality or size) of paper sheets 200, however, the respective MP tray 300 and paper feeding cassettes 301 to 305 may store a different type (such as paper quality or size) of paper sheets 200. In this case, upon the panel operation control part 130 having received a setting of a type (such as paper quality or size) of paper sheets 200 by the user through the panel part 103, the panel operation control part 130 notifies the system control part 132 of the setting. The system control part 132 notifies the paper feeding stage searching part 129 of the contents of the type (such as paper quality or size) of the paper sheet 200 that has been set. Thereby, the paper feeding stage searching part 129 can omit the paper feeding stage searching operation on the MP tray 300 or any one of the paper feeding cassettes 301 to 305 that stores the different type (such as paper quality or size) of paper sheets 200.

In this way, in the present embodiment, if the system control part 132 notifies the paper feeding stage searching part 129 of a detection result by the paper sheet detection sensors 105*a* to 105*f*, and any one of the paper feeding cassettes 301 to 305 that is specified as the default, the paper feeding stage searching part 129 selects a searching pattern according to the detection result by the paper sheet detection sensors 105*a* to 105*f* and the default for performing a paper feeding stage searching operation. Then, the system control part 132 performs changeover of paper feeding stages to any one of the paper feeding stages 301 to 305 based on the levels of priority in paper feeding stage searching operation selected by the paper feeding stage searching part 129.

Specifically, in the case where the detection result by the paper sheet detection sensors 105*a* to 105*f* indicates that the paper feeding cassettes 301 to 305 have all the paper sheet 200, the paper feeding stage searching part 129 performs a paper feeding stage searching operation in the searching pattern 1 (a first searching pattern) based on the levels of priority in paper feeding stage searching operation that indicate the order in which the paper feeding stage searching operation is performed from the paper feeding cassette 302 of the default toward the lower stages as explained with reference to FIG. 3A.

In this case, in the state in which, at the time of starting the printing, the paper feeding cassettes 301 to 305 have all the paper sheet 200, the possibility of any one of the paper feeding cassettes 301 to 305 being opened and closed for replenishing it with paper sheets 200 during execution of the printing is low. Thereby, even if the paper sheets 200 in a paper feeding stage that is in the course of paper sheet feeding have been used up, paper sheet feeding is performed from the paper feeding stage at a next higher level of priority in paper feeding stage searching operation, whereby the possibility of occurrence of a paper sheet jam is eliminated, and the convenience for the user can also be maintained.

In addition, in the case where the detection result by the paper sheet detection sensors 105*a* to 105*f* indicates that, under the default, there exists any one of the paper feeding cassettes 301 to 305 that is in the state of paper sheet absence, the paper feeding stage searching part 129 performs a paper feeding stage searching operation in the searching pattern 2 (a second searching pattern) in which the levels of priority in paper feeding stage searching operation on the paper feeding cassettes 304 and 305 under the paper feeding cassette 303 in the state of paper sheet absence are made lower than the levels of priority in paper feeding stage searching operation on the MP tray 300 and the paper feeding cassettes 301 and 302 above the paper feeding cassette 303 in the state of paper sheet absence as explained with reference to FIG. 3B. In the case where there exists the MP tray 300 at the highest stage, the level of priority in paper feeding stage searching operation on the MP tray 300 is next higher to the level of priority in paper feeding stage searching operation on the paper feeding cassette 302.

In this case, by making the levels of priority in paper feeding stage searching operation on the paper feeding cassettes 304 and 305, which are located under the paper feeding cassette 303 in the state of paper sheet absence, lower, it is made possible to perform paper sheet feeding in the course of printing from the paper feeding cassettes 301 and 302, and the MP tray 300, which are in the state of paper sheet presence. Thereby, in the same manner as described above, the possibility of occurrence of a paper sheet jam is eliminated, and the convenience for the user can also be maintained.

In addition, in the case where the detection result by the paper sheet detection sensors 105*a* to 105*f* indicates that, above the default, there exists any one of the paper feeding cassettes 301 to 305 that is in the state of paper sheet absence, the paper feeding stage searching part 129 performs a paper feeding stage searching operation in the searching pattern 3 (a third searching pattern) in which the level of priority in paper feeding stage searching operation on the paper feeding cassette 301 at the highest stage (in FIG. 3C, the MP tray 300 is located at the highest stage) is made the highest, and the levels of priority in paper feeding stage searching operation on the paper feeding cassettes 304 and 305 under the paper feeding cassette 303 in the state of paper sheet absence are made lower than the levels of priority in paper feeding stage searching operation on the paper feeding cassettes 301 and 302 above the paper feeding cassette 303 in the state of paper sheet absence as explained with reference to FIG. 3C.

In this case, the paper feeding cassette 304 (the default) is located under the paper feeding cassette 303, which is in the state of paper sheet absence, however, the level of priority in paper feeding stage searching operation on the paper feeding cassette 301, which is located above the paper feeding cassette 303, is made the highest (in FIG. 3C, the MP tray 300 is located at the highest stage), and the levels of priority in paper feeding stage searching operation on the paper feeding cassettes 304 and 305 under the paper feeding cassette 303 in the state of paper sheet absence are made lower than the levels of priority in paper feeding stage searching operation on the paper feeding cassettes 301 and 302 above the paper feeding cassette 303 in the state of paper sheet absence as explained with reference to FIG. 3C, whereby it is made possible to perform paper sheet feeding in the course of printing from the paper feeding cassettes 301 and 302 in the state pf paper sheet presence. Thereby, in the same manner as described above, the possibility of occurrence of a paper sheet jam is eliminated, and the convenience for the user can also be maintained.

In addition, in the case where the detection result by the paper sheet detection sensors 105*a* to 105*f* indicates that, above the default, there exists any one of the paper feeding cassettes 301 to 305 that is in the state of paper sheet absence, the paper feeding stage searching part 129 performs a paper feeding stage searching operation in the searching pattern 4 (a fourth searching pattern) in which the level of priority in paper feeding stage searching operation on the paper feeding cassette 301 which is located at the highest stage, is made the highest (in FIG. 3C, the MP tray 300 is located at the highest stage), and the paper feeding stage searching operation on the paper feeding cassettes 304 and 305 under the paper feeding cassette 303 in the state of paper sheet absence is not performed.

In this case, since paper sheet feeding is not performed from the paper feeding cassettes 304 and 305, which is located under the paper feeding stage having no paper sheets 200, whereby occurrence of a paper sheet jam can be positively avoided with the convenience for the user being maintained.

With a typical image forming apparatus, by causing paper sheet feeding from a paper feeding cassette selected based on the levels of priority for the paper feeding cassettes, it can be avoided, for example, that the image data for a single copying job is printed on different types of paper sheets.

By the way, some models of the image forming apparatus in the recent years omit a cassette detection sensor for detecting the open/closed state of a paper feeding cassette for the purpose of cost reduction. In addition, in order to achieve such a purpose as downsizing the apparatus, with some models, a plurality of paper feeding cassettes provided with a common carrying passage for paper sheets fed from the lower stages are stacked in a vertical direction.

Then, if, to such an image forming apparatus for which cost reduction, downsizing, and the like, are intended to be achieved at the same time, the method is applied that causes paper feeding from a selected paper feeding cassette to be performed based on the levels of priority for the paper feeding cassettes in the typical technique, there is the possibility that the following problems may be presented.

In other words, even in the case where the cassette detection sensor is omitted, a paper sheet detection sensor for detecting whether or not a paper sheet is stored is provided, and therefore, it is possible to detect whether or not a paper sheet is stored in a paper feeding cassette. In this case, in the event that the paper sheets in the paper feeding cassette in the course of paper feeding have been used up, following the above-mentioned levels of priority will result in selection of a paper feeding cassette other than the paper feeding cassette that has been determined to be in the state of paper sheet absence.

However, in the case where the cassette detection sensor is omitted, if a cassette is brought into the open state, it is not possible to detect whether or not the paper sheets therein have been used up. In this case, it is determined that the paper sheets have been used up. Then, if the above-mentioned levels of priority are followed, a paper feeding cassette other than the paper feeding cassette that has been determined to be in the state of paper sheet absence will be selected in the same manner as described above.

However, in the case where the selected paper feeding cassette is located under the paper feeding cassette in the open state, the common carrying passage for a paper sheet to be fed from the selected paper feeding cassette is lost. In this case, a paper sheet jam will be caused.

In such a situation, it has been demanded to develop an apparatus that allows coexistence of the convenience for the user and the release of the possibility of occurrence of a paper sheet jam.

According to the image forming apparatus of the present disclosure, the system control part performs changeover of paper feeding stages based on the levels of priority in paper feeding stage searching operation in the searching pattern that has been selected by the paper feeding stage searching part, whereby coexistence of the convenience for the user and the release of the possibility of occurrence of a paper sheet jam can be achieved.

In addition, in the above explanation, it is assumed that the paper feeding stages (the MP tray 300 and the paper feeding cassettes 301 to 305) all store the same type (such as paper quality or size) of paper sheets 200, however, even in the case where any one of the paper feeding stages stores paper sheets 200 that are different from paper sheets 200 stored in the other paper feeding stages, the present disclosure may be implemented. In this case, the paper feeding stage searching part 129 may make only the paper feeding stages that have the same type of paper sheets 200 as that for the paper feeding stage of the default the objects in paper feeding stage searching operation.

What is claimed is:

1. An image forming apparatus, comprising a plurality of paper feeding stages that are detachably loaded in the inside of a main body of the apparatus, having a common carrying passage that carries a paper sheet from a lower stage, a plurality of paper sheet detection sensors that detect a paper sheet stored in the respective paper feeding stages of the plurality of paper feeding stages, and a processor, upon the processor executing a program, the processor operating as a paper feeding stage searching part that has a plurality of searching patterns for performing the paper feeding stage searching operation, wherein the plurality of searching patterns vary in levels of priority in which paper feeding stages are searched by the paper stage searching operation, and wherein, every time paper sheet feeding from a paper feeding stage is performed, the paper feeding stage searching part performs a paper feeding stage searching operation based on any one of the searching patterns, and a system control part that notifies the paper feeding stage searching part of a detection result by the plurality of paper sheet detection sensors and a paper feeding stage that is specified as a default paper feeding stage from which to perform paper feeding, upon the processor executing a program, the processor selecting, for use by the paper feeding stage searching part, a searching pattern from the plurality of searching patterns according to the detection result and the default paper feeding stage to perform a feeding stage searching operation, and performing, as the system control part, changeover of the paper feeding stages based on the levels of priority in paper feeding stage searching operation in the searching pattern.

2. The image forming apparatus according to claim 1, wherein, upon the processor executing a program, the processor, in the case where the detection result by the paper sheet detection sensor indicates that all the paper feeding stages have paper sheets, performs, as the paper feeding stage searching part, a feeding stage searching operation in a first searching pattern based on the levels of priority in paper feeding stage searching operation that indicate the order of performing a searching operation from the feeding stage of the default towards the lower stages.

3. The image forming apparatus according to claim 1, wherein, upon the processor executing a program, the processor, in the case where the detection result by the plurality of paper sheet detection sensors indicates that there exists no paper sheets in the default paper feeding stage, performs, for use by the paper feeding stage searching part, a feeding stage searching operation in a second searching pattern in which the levels of priority in paper feeding stage searching operation on the paper feeding stages under the paper feeding stage in the state of paper sheet absence are made lower than the levels of priority in paper feeding stage searching operation on the paper feeding stages above the paper feeding stage in the state of paper sheet absence.

4. The image forming apparatus according to claim 1, wherein, upon the processor executing a program, the processor, in the case where the detection result by the paper sheet detection sensor indicates that there exists the paper sheet stage in the state of paper sheet absence above the default, performs, as the paper feeding stage searching part, a feeding stage searching operation in a third searching pattern in which the level of priority in paper feeding stage searching operation on the paper feeding stage at the highest stage is made the highest, and the levels of priority in paper feeding stage searching operation on the paper feeding stages under the paper feeding stage in the state of paper sheet absence are made lower than the levels of priority in paper feeding stage searching operation on the paper feeding stages above the paper feeding stage in the state of paper sheet absence.

5. The image forming apparatus according to claim 4, wherein, upon the processor executing a program, the processor, in the case where the paper feeding stage that is specified as the default is in the state of paper sheet absence, performs, as the paper feeding stage searching part, a paper stage searching operation in the third pattern.

6. The image forming apparatus according to claim 1, wherein, upon the processor executing a program, the processor, in the case where the detection result by the paper sheet detection sensor indicates that there exists the paper sheet stage in the state of paper sheet absence above the default, performs, as the paper feeding stage searching part, a feeding stage searching operation in a fourth searching pattern in which, on the paper feeding stages above the paper feeding stage in the state of paper sheet absence, a feeding stage searching operation is performed, and on the paper feeding stages under the paper feeding stage in the state of paper sheet absence, no feeding stage searching operation is performed.

7. The image forming apparatus according to claim 1, wherein there is provided a printer, and upon the processor executing a program, the processor, in the case where there are a first plurality of the paper feeding stages in the state of paper sheet absence, performs, for use by the paper feeding stage searching part, a paper feeding stage searching operation by selecting a first searching pattern, wherein the first searching pattern is the pattern that would be selected in the case where only the paper feeding stage, of the first plurality of the paper feeding stages, that is the closest to the printer is in the state of paper sheet absence.

8. The image forming apparatus according to claim 1, wherein there is provided a manual feed tray, and a second paper sheet detection sensor that detects a paper sheet stored in the manual feed tray, wherein upon the processor executing a program, the processor, in the case where a detection result by the second paper sheet detection sensor indicates that the manual feed tray has a paper sheet, makes, for the paper feeding stage searching part, the manual feed tray as an object of the paper feeding stage searching.

* * * * *